United States Patent [19]

Shinomiya

[11] Patent Number: 4,986,731

[45] Date of Patent: Jan. 22, 1991

[54] SHEET HANDLING APPARATUS

[75] Inventor: Tsutomu Shinomiya, Sapporo, Japan

[73] Assignee: Hokkai Can Co., Ltd., Tokyo, Japan

[21] Appl. No.: 188,767

[22] Filed: May 3, 1988

Related U.S. Application Data

[63] Continuation of Ser. No. 877,800, Jun. 24, 1986, abandoned.

[30] Foreign Application Priority Data

Jun. 24, 1985 [JP] Japan ..... 60-135972
Jun. 29, 1985 [JP] Japan ..... 60-98345[U]

[51] Int. Cl.[5] ..... B65H 3/04

[52] U.S. Cl. ..... 414/798.9; 198/412; 198/418.7; 271/150; 414/786; 414/796; 414/796.4

[58] Field of Search ..... 271/3.1, 150, 151; 198/412, 418.7, 461; 414/788.5, 796, 796.4, 797.2, 798.9, 757, 774, 784, 786

[56] References Cited

U.S. PATENT DOCUMENTS

| | | | |
|---|---|---|---|
| 4,042,234 | 8/1977 | Tokuno | 271/151 |
| 4,049,260 | 9/1977 | Szymborski | 271/151 |
| 4,240,539 | 12/1980 | Klapp | 271/151 X |
| 4,249,847 | 2/1981 | Tokuno | 414/330 |
| 4,316,607 | 2/1982 | Hayashi et al. | 271/151 |

*Primary Examiner*—Robert J. Spar
*Assistant Examiner*—Janice Krizek

[57] ABSTRACT

The present invention is directed to an apparatus and method for receiving a stack of sheets, with each sheet oriented in a standing position on edge, and rotating a predetermined number of sheets from the stack of sheets to a laid position. The apparatus includes a first conveying surface attached to a second conveying surface having two portions. The first portion of the second conveying surface is inclined for separating and rotating the predetermined number of sheets from the stack of sheets.

18 Claims, 3 Drawing Sheets

SHEET HANDLING APPARATUS

This application is a continuation of application Ser. No. 877,800 filed on June 24, 1986, now abandoned.

BACKGROUND OF THE INVENTION

This invention relates to an apparatus for transporting sheets in which a pile of a large number of sheets, positioned on edge in an upright position relative to the transporting direction, is separated into a group of a predetermined number of sheets from the foregoing pile of sheets. At the same time, the group of a predetermined number of sheets is pivoted to a laid position with the front surfaces thereof facing upward and the lower edges thereof facing forward. Each group of sheets is fed out of the apparatus in the laid position.

As for existing apparatus of a related type, U.S. Pat. No. 4,249,847 discloses a related device as shown in FIGS. 6–8. This device comprises a first conveyer b for transporting, in a transporting direction X, a pile of a large number of sheets on edge in an upright position thereon, and a tilting device g for tilting a transfer conveyer c which is disposed at the delivery end of the first conveyer b. When the first conveyer b is stopped, a conveying surface e of the transfer conveyer c can be raised above a conveying surface f, of the first conveyer b, and thereby cause a group of a predetermined number of sheets to separate from the remaining group thereof and at the same time cause the group of a predetermined number of sheets to pivot to a laid position with the front faces of the sheets facing upward and the lower edges thereof facing forward. A second conveyer h receives the group of the predetermined number of sheets in the laid position from the transfer conveyer c.

Thus, according to this existing conventional apparatus, when the pile of sheets a positioned in the upright position is transported to the delivery end d of the first conveyer b, and the conveyer b is stopped, the conveying surface e of the transfer conveyer c is raised by the tilting device g in the direction of arrow i shown in FIG. 8. The conveying surface e is then positioned higher than the conveying surface f of the first conveyer b, so that a leading group of a predetermined number of the sheets a is separated and pivoted from the remaining group of the pile of sheets a and at the same time the group of a predetermined number of sheets is brought to a laid position as mentioned above. Thus, a group of a predetermined number of sheets is obtained at each cycle of rise and fall of the transfer conveyer c by the tilting means g and conveyed to a second conveyer one group after another. Accordingly, the conveying surface e of the transfer conveyer c is lifted and lowered by tilting means g in relation to the conveying surface f of the first conveyer b each time a group of a predetermined number of the sheets a needs to be obtained. The tilting means g and the related apparatus results in an apparatus that is complicated and requires repeated controlling operations for lifting and lowering the transfer conveyer c simultaneous with the operations for stopping and resuming movement of the first conveyer b for obtaining each group of sheets a.

SUMMARY AND OBJECTS OF THE INVENTION

A purpose of this invention is to provide an apparatus for transporting sheets in which each leading group of a predetermined number of sheets separated from a pile of a large number of sheets positioned on edge in an upright position on a first conveyer, is pivoted to a laid position by a transfer conveyer without the necessity of raising and lowering a transfer conveyer resulting in an apparatus in which construction and operation is simplified over conventional apparatus of a related type.

The apparatus of the present invention comprises a first conveyer for conveying forward a pile of a large number of sheets positioned on edge in an upright position. A transfer conveyer is positioned at a delivery end of the first conveyer and extends in the same direction as the first conveyer. A predetermined number of sheets are sent to the transfer conveyer, from the first conveyer, and are pivoted to a laid position with the front faces of the sheets facing upward and the lower edges thereof facing forward. The conveying surface of the transfer conveyer of the present invention comprises a first conveying surface which extends from a position below a conveying surface of the first conveyer to a position above the same. A second conveying surface of the transfer conveyer extends at an inclination angle $\theta_1$ relative to the first conveying surface of the transfer conveyer. The inclination angle $\theta_1$ is smaller than an inclination angle $\theta_2$ defined between the first conveying surface of the transfer conveyer and the conveying surface of the first conveyer. The transfer conveyer is so arranged as to be higher in conveying speed than the first conveyer.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
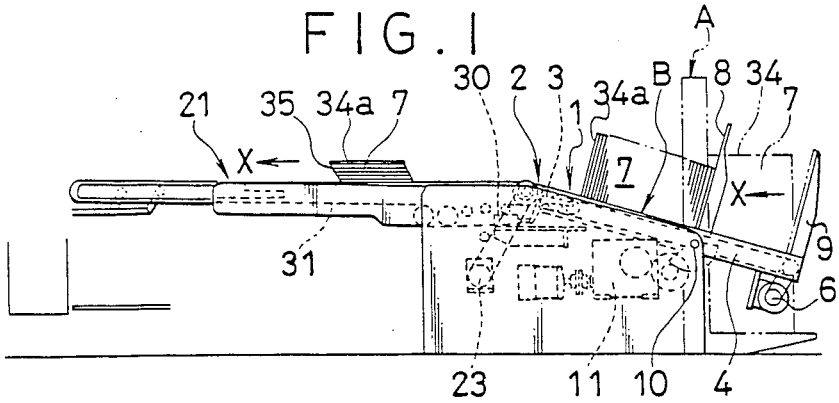
FIG. 1 is a side view of an embodiment of the present invention.

Referring to FIGS. 1–4 showing one embodiment of the present invention used for a sheet transporting apparatus, the apparatus includes a first conveyer 1, a transfer conveyer 2 and a lifting means 3.

The first conveyer 1 comprises plural parallel spaced endless chain conveyers 5 disposed laterally at equal intervals in a space defined between a pair of side frames 4,4. The chain conveyers 5 are driven by an electric motor 6. A fork 8 is connected to the chain conveyers 5 in order to move a pile of a large number of sheets 7 such as corrugated cardsheets in the transporting direction X by cooperation of the chain conveyers 5. The first conveyer 1 is arranged to receive a large number of sheets 7 placed one upon another in layers with their front surfaces upward and with their lower edges forward on a carrier base 9. The carrier base 9 includes an arrangement of rollers together with a fork 8 and is further provided with a shaft 10 rotatably supporting the chain conveyers 5, the fork 8 and side frames 4. In addition, the first conveyer 1 is provided with a driving means 11 for pivoting the chain conveyers 5, the fork 8 and the side frames 4 from a position A, at which position piled sheets 7 are positioned in carrier base 9 as shown by imaginary lines in FIG. 1, to B position at which piled sheets 7 are received by the first conveyer in an upright position with their front faces facing forward and their lower edges facing downward resting on the chain conveyers 5 as shown by solid lines in FIG. 1.

Further, in the illustrated example, the chain conveyers 5 are arranged that when they are brought into the delivery position B, the delivery ends 12 thereof are positioned in a slightly upward inclined position as shown in FIG. 1.

The transfer conveyer 2 comprises plural parallel spaced endless belt conveyers 13 which are disposed laterally at regular intervals and extend in the transporting direction X of the piled sheets 7.

Figure 3:
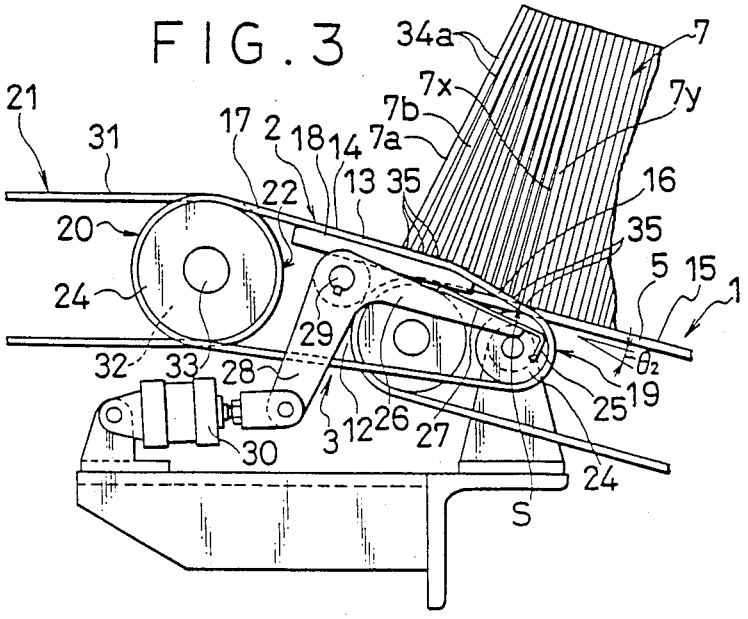
FIGS. 3 and 4 are enlarged side views of important portions thereof.

A conveying surface 14 of belt conveyers 13, as shown in FIG. 3, includes a first conveying surface 16 which extends obliquely between a position below conveying surface 15 of each chain conveyer 5 of the first conveyer 1 and a position above the same. The conveying surface 16 has an inclination angle $\theta_2$ in relation to the conveying surface 15 of each chain conveyer 5. The conveying surface 16 has an inclination angle $\theta_1$, in relation to second transfer conveyer surface 17. The inclination angle $\theta_1$ is smaller than the inclination angle $\theta_2$. There is provided a guide member 18 on the lower surface of the belt conveyer 13 for keeping the first conveying surface 16 and the second conveying surface 17 at their respective predetermined angles. In addition, endless belt conveyers 13 of the transfer conveyer 2 are positioned so that an intake end 19 of each of the belt conveyers 13 may be inserted into a space between two adjacent delivery ends 12 of the chain conveyers 5 of the first conveyer 1 when the first conveyer 1 is moved in the delivery position B. Further, the transfer conveyer 2 is arranged that a feeding out end 20 of each of the belt conveyers 13 thereof may be inserted into a space formed between two adjacent receiving ends 22 of a receiving means 21 as explained in detail hereinafter.

The belt conveyers 13 are arranged to be driven in the transporting direction X by an electric motor 23. Furthermore, the conveying surface 14 of the conveyer 2 is moved at conveying speed $V_2$. Belt conveyers 13 are arranged to be driven at a speed higher than a conveying speed $V_1$ of the conveying surface 15 of the first conveyer 1.

A lifting means 3 is provided with a flat plate-shaped lifting portion 27. An end of the lifting means 3 is bent downward to form a bent part 25. A lower surface of the lifting means 3 is supported on an L-shaped swing arm 26. Additionally, the lifting means 3 is provided with an oil-pressure or air-pressure operated type piston cylinder means 30 operatively attached to connecting portion 28 of swing arm 26 for moving the lifting portion 27 together with the bent portion 25. The lifting portion 27, attached to swing arm 26 and pivoted about shaft 29, is moved upward and downward above and below the first conveying surface 16 of the transfer conveyer 2.

Figure 2:
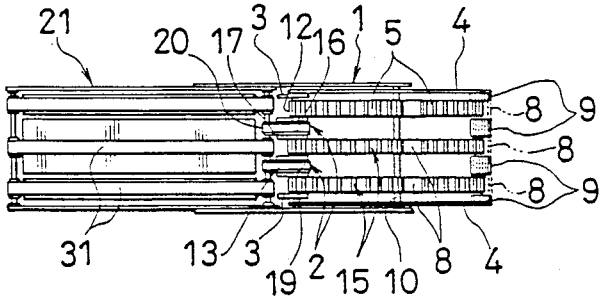
FIG. 2 is a top view, partly omitted, of the same with a first conveyer being in its delivery condition.
Figure 4:
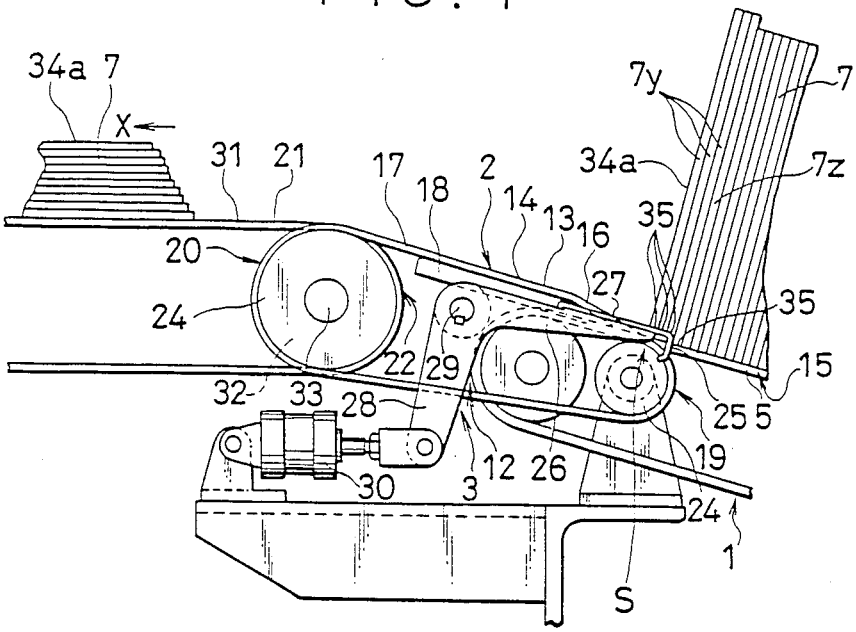

As shown in FIGS. 2 and 3, plural lifting means 3 are disposed so that each of the lifting means 3 is located below a separation position for the pile of sheets positioned on each chain conveyer 5 of the first conveyer 1. The separation position corresponds to an intersection point between the first surface 16 of the transfer conveyer 2 and the conveying surface 15 of the first conveyer 1. A predetermined number of sheets forming a leading group of piled sheets 7, oriented in an upright position on the first conveyer 1, are fed forward onto the conveying surface 16 of the transfer conveyer 2. The lifting part 27 and the bent part 25 thereof are raised above the conveying surface 15 of the first conveyer 1 for lifting a few sheets of the piled sheets off the first conveyer 1 as shown in FIG. 4. The lower edges 35 of the few sheets are lifted off the running transfer conveyer 2, which is running forwards, so as to separate the leading group from the remaining group of piled sheets 7 on the first conveyer 1 and lay the same in such a laid position that their front surfaces face upward and their lower edges face forward. The resultant laid group of sheets are conveyed to receiving means 21.

The receiving means 21 comprises plural parallel spaced feed conveyers 31 provided at proper intervals in the lateral direction and extend in the same direction as the transportation direction X of the sheets 7. In the illustrated example, a shaft 33 having driving pulleys 32 is provided on the receiving end 22 of the feed conveyers 31. Shaft 33 is also provided with driving pulleys 24 provided on the outlet end 20 of the belt conveyers 13 of the transfer conveyer 2. Since pulleys 32 and 24 are disposed on the same shaft 33 driven by means of an electric motor 23, conveyers 31 and 13 can be driven at the same time and at the same speed.

Operation of the above described apparatus will be explained as follows:

A large number of sheets 7 are placed one upon another to form a pile thereof with their front surfaces 34 upward. The pile is sent by a carrier (not illustrated) to the first conveyer 1 positioned in receiving position A as shown by imaginary lines in FIG. 1. The pile of sheets 7 on the carrier are transferred onto carrier base 9.

The driving means 11 is then operated and the first conveyer 1 is pivoted about shaft 10 into delivery position B as shown by solid lines in FIG. 1. The pivoted sheets 7 are positioned in an upright position on edge with their previous upward facing surfaces 34 now being forward facing surfaces **34*a*. The previously forward facing edges of the pivoted sheets are now downward facing edges resting on the conveying surface 15 of the first conveyer 1**.

Then, in accordance with an operation of the electric motor 5, the pile of sheets 7 in the upright position on the chain conveyers 5 are driven forward, together with the fork 8, to the delivery end 12 of the chain conveyers 5. As shown in FIG. 3, the lower edge 35 of the foremost sheet **7*a* of the pile of sheets 7 reaches the delivery end 12 of the chain conveyers 5. The lower end 35 of the foremost sheet 7*a* is sent onto the intake end 19 of the belt conveyer 13 of the transfer conveyer 2. The conveying speed of the lower edge 35 of the foremost sheet 7*a* is accelerated by the first conveying surface 16 of the transfer conveyer 2 having a conveying speed $V_2$. Conveying speed $V_2$ is greater than the conveying speed $V_1$ of the first conveyer 1, whereby the lower edge 35 is fed forward to the second conveying surface 17 of the transfer conveyer. Similarly, respective lower edges 35** of the sheets *7b* .... 7X are moved forwards to the second conveying surface 17 after being moved forward at an accelerated speed by the first conveying surface 16. Thus, a predetermined number of sheets forming a leading group of the pile sheets 7 are positioned on the first conveyer 1 and are advanced forward on transfer conveyer 2. When the lower edge 35 of a rearmost sheet 7X, of the leading group of a predetermined number of sheets, reaches separation position S on the conveying surface 15 of the first conveyer 1, the first conveyer 1 is stopped in operation resulting in the discharge of a predetermined number of sheets 7 to the transfer conveyer 2 and the delivery in the transporting direction X of the remaining group of piled sheets 7 following the leading group is stopped.

After the stop in delivery of the sheets 7, in the transporting direction X to the transfer conveyer 2, the piston cylinder means 30 is operated, as shown in FIG. 4, causing the rotation of the connecting portion 28 of the swing arm 26. The swing arm 26 rotates in the counterclockwise direction about the shaft 29 so that the bent part 25 and the lifting part 27 supported on the swing arm 26 are raised. Thereby, a few sheets *7y* which are positioned forward of the remaining group of sheets 7 on the first conveyer 1 are slightly lifted by the lifting part 27 to the first conveying surface 16 of the transfer conveyer 2. On this occasion the bent part 25 is moved to slide upwards along the lower part of the front surface of the sheet *7z* (FIG. 4) following the sheet *7y* so as not to damage the same.

The respective lower edges 35 of the group of the sheets 7 of a predetermined number received by the first conveying surface 16 of the transfer conveyer 2 have a conveying speed $V_2$ which is higher than conveying speed $V_1$ of the first conveyer 1. The sheets are further advanced by the first conveying surface 16 and the second conveying surface 17, of the transfer conveyer 2. The sheets further advanced by the first conveying surface 16 and the second conveying surface 17, of the transfer conveyer 2, are automatically brought into a laid position such that the front surfaces 34*a* thereof are directed upward and the lower edges 35 thereof are directed forward. The laid group of sheets 7 is conveyed forward from the outlet end 20 of the transfer conveyer 2 to the receiving end 22 of the receiving means 21 and then are conveyed in the transfer direction X by the feed conveyer 31 of the receiving means 21 as shown in FIG. 4.

Thereafter, the same sequential operations as explained above are repeated and a new group of a predetermined number of sheets 7 in the laid position as above can be obtained one after another in sequence from the pile of the large number of the sheets 7 positioned on edge in the upright position on the first conveyer 1 by means of the transfer conveyer 2 having a first conveying surface 16 and a second conveying surface 17.

During the running of the transfer conveyer 2, the leading sheets of the remaining group of sheets 7 are never brought into contact with the running transfer conveyer 2 so that none of the sheets 7 are damaged.

Figure 5:
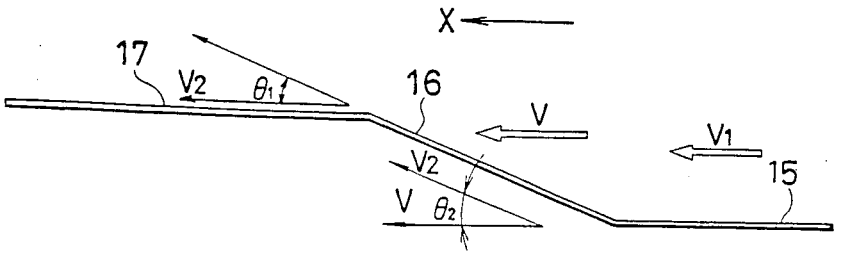
FIG. 5 is an explanation diagram of the same.
Figure 6:
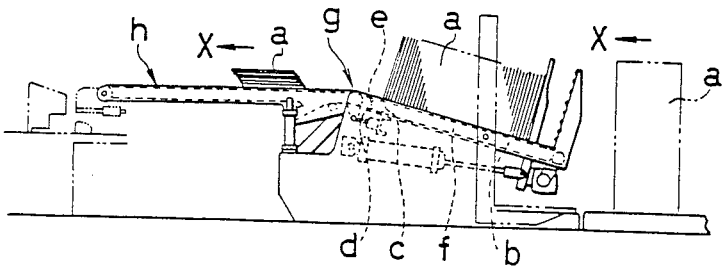
FIG. 6 PRIOR ART
FIG. 6 is a side view of a conventional related apparatus.
Figure 7:
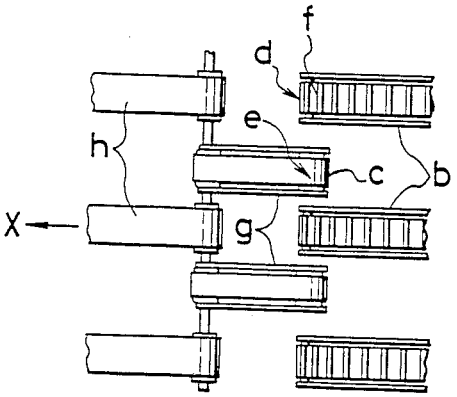
FIG. 7 PRIOR ART
FIG. 7 is a top view of a portion thereof.
Figure 8:
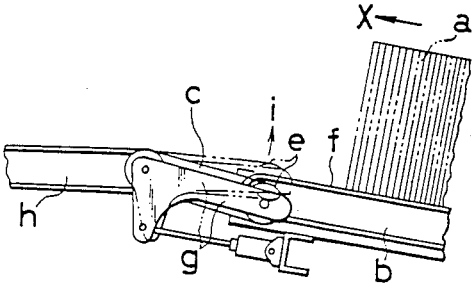
FIG. 8 PRIOR ART
FIG. 8 is a side view of the same.

As shown clearly in FIG. 5, the first conveying surface 16 of the transfer conveyer 2 has an upward inclination angle $\theta_2$ in relation to the conveying surface 15 of the first conveyer 1. A speed V of the lower edge 35 of the sheet 7 discharged in the transporting direction X onto the first conveying surface 16 of the transfer conveyer 2 can be obtained by the following formula:

$V = V_2 \times \cos\theta_2$, where $V_2$ represents the speed of transfer conveyer 2.

Accordingly, in a case where a conveying speed $V_1$ of the first conveyer 1 is 25 m/min., the conveying speed $V_2$ of the transfer conveyer 2 is 50 m/min., and the inclination angle $\theta_2$ is 40°, the speed V of the lower edge 35 of the sheet 7 in the x-direction is as follows:

$V = 50 \times \cos 40° = 38.3$ m/min.

Thus, the lower edges 35 of the sheets 7 are discharged onto the transfer conveyer 2 at a speed which is faster than the conveying speed $V_1$ of the first conveyer 1, but is slower than the conveying speed $V_2$ of the transfer conveyer 2. The lower edge 35 of a sheet can be fed forward without being conveyed forward as rapidly as the speed of the first conveying surface 16.

Accordingly, a phenomenon can be prevented, in which the upper edge of a sheet 7 with its lower edge 35 being conveyed forward as mentioned above slides along the front surface of a sheet 7 following the same and thus the lower edges 35 of the sheets are spread and spaced too much from each other resulting in a collapsed laid group thereof on the second conveyor 21. In other words, due to the resultant speed V of the lower edge of the sheets being conveyed, a predetermined number of sheets 7 can be properly spread at their lower edges 35 with their upper edges not being slid on the front surfaces of individual subsequent sheets and a group of sheets can be pivoted with their upper edges properly brought into a desired laid position with their front surfaces upward and with their lower edges forward on the transfer conveyer 2. The laid group of sheets can be fed forward onto the receiving second conveyor 21. In this case, owing to the fact that the second conveying surface 17 of the transfer conveyer extends at inclination angle $\theta_1$ in relation to the first conveying surface 16 thereof, that is smaller than the inclination angle $\theta_2$ and has a running speed in the x-direction which is faster than the running speed in the x-direction of the first conveying surface 16, the foregoing sheet lay down operation can be carried out reliably and smoothly.

Thus, according to this invention, the transfer conveyer is composed of a first conveying surface and a second conveying surface. The second conveying surface has an inclination angle $\theta_1$ relative to the first conveying surface that is smaller than inclination angle $\theta_2$ made between the first conveying surface of the transfer conveyer and the conveying surface of the first conveyer. The transfer conveyer is arranged to be driven faster than the first conveyer. The apparatus can lay a predetermined number of sheets, of a leading group from a pile of sheets, from an upright position on the first conveyer to a laid position with their front surfaces facing upward and with their edges facing forward without requiring a tilting device for tilting the transfer conveyer which has been required in existing apparatus. The present invention results in an apparatus having a simpler construction and operation than existing apparatus.

In addition, according to this invention, a lifting means is provided below a separation position for the pile of sheets which corresponds to an intersection position between the conveying surface of the first conveyer and the first conveying surface of the transfer conveyer. The lifting means prevents the lower edges of the leading group of sheets from being damaged by the running transfer conveyer. The lifting means can separate a predetermined number of sheets by lifting them onto the transfer conveyer without the lower edges of the sheets being damaged by the running transfer conveyer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An apparatus for handling a stack of sheets of material, said apparatus comprising:

a first conveying surface for receiving and supporting the stack of sheets, each of said sheets having a front surface and a rear surface with each of said sheets positioned in a standing position on a lower edge, said first conveying surface being positioned substantially horizontally and driven at a predetermined speed $V_1$; and a second conveying surface for receiving a predetermined number of sheets of the stack of sheets and for pivoting said predetermined number of sheets from a standing position to a laid position, said second conveying surface being positioned adjacent to said first conveying surface, said second conveying surface including a first conveying surface portion inclined at a first angle relative to said first conveying surface, said second conveying surface including a second conveying surface portion disposed substantially parallel to said first conveying surface at a second angle relative to said first conveying surface portion of said second conveying surface, said second conveying surface being driven at a predetermined speed $V_2$ having a vector component V;

wherein the magnitudes of said first angle, said second angle, said predetermined speed of said first conveying surface and said predetermined speed of said second conveying surface are selected so that said predetermined number of sheets are pivoted from a standing position on said lower edges to a laid position with said front surface of each of said sheets facing upwardly and with said lower edges facing forward in the direction of movement of said second conveying surface due to forces exerted on said predetermined number of sheets as a consequence of said selected magnitudes of said angles and as a consequence of the difference between said speed $V_1$ of said first conveying surface and said component V of said speed $V_2$ of said second conveying surface, the direction of said component V being in parallel to said first conveying surface.

2. The apparatus according to claim 1, including a lifting means for lifting up above said second conveying surface, a few sheets which are positioned forward of a remaining group of said stack of sheets positioned on said first conveying surface, after said predetermined number of sheets are transferred from said first conveying surface to said second conveying surface.

3. The apparatus according to claim 1, wherein said first angle is greater than said second angle.

4. The apparatus according to claim 2, wherein said first angle is greater than said second angle.

5. The apparatus according to claim 1, wherein said speed $V_2$ of said second conveying surface is greater than said speed $V_1$ of said first conveying surface.

6. The apparatus according to claim 4, wherein said speed $V_2$ of said second conveying surface is greater than said speed $V_1$ of said first conveying surface.

7. An apparatus for handling a plurality of sheets of material, each said sheet having a pair of faces and a plurality of edges, said apparatus comprising:

first conveying means for receiving and conveying a stack of said sheets, said first conveying means including a substantially horizontally disposed first conveying surface which receives said sheets stacked face to face and collectively supported on edge and conveys said sheets, said first conveying surface being driven at a predetermined speed $V_1$;

second conveying means, positioned adjacent to said first conveying means for tilting a substack of said stack of sheets, said second conveying means including a second conveying surface, said second conveying surface having a first portion and a second portion, said first portion being inclined at a first angle with respect to said first conveying surface, said second portion operatively connected to said first portion for receiving said substack of said stack of sheets from said first portion, said second portion being more horizontally disposed than said first portion and being inclined at a second angle relative to said first portion, said second conveying surface being driven at a predetermined speed $V_2$ having a vector component V; and third conveying means positioned adjacent said second conveying means for receiving and transporting said substack of said stack of sheets in a face supported position from said second portion to a delivery location;

wherein the magnitudes of said first angle, said second angle, and speed of said first and second conveying surfaces are selected so that said substack of said stack of sheets are pivoted from a standing position on edge to a laid position on said third conveying means due to forces exerted on said substack of said stack of sheets as a consequence of said selected magnitudes of said angles and as a consequence of the difference between said speed $V_1$ of said first conveying surface and said component V of said speed $V_2$ of said second conveying surface, the direction of said component V being in parallel to said first conveying surface.

8. The apparatus according to claim 7, including lifting means for lifting up above said second conveying surface a few sheets which are positioned forward of a remaining group of said stack of sheets positioned on said first conveying surface, after said substack of said stack of sheets are transferred from said first conveying means to said second conveying means.

9. The apparatus according to claim 8, wherein said first angle is greater than said second angle.

10. The apparatus according to claim 9, wherein said speed $V_2$ of said second conveying surface is greater than said speed $V_1$ of said first conveying surface.

11. A method of handling a stack of sheets comprising:

(a) selecting predetermined magnitudes of speed $V_1$ of a first conveying surface, of speed $V_2$ of a second conveying means having a first conveying surface portion and a second conveying surface portion, said speed $V_2$ having a vector component V, of a first angle representing the relative angle of incline between said first conveying surface and said first conveying surface portion, and of a second angle representing the relative angle of incline between said first conveying surface portion and said second conveying surface portion;

(b) loading a pile of sheets, each of said sheets having a front surface and a rear surface and being disposed in a standing position on a lower edge, onto said first conveying surface;

(c) separating a predetermined number of sheets from said pile;

(d) transferring said predetermined number of sheets onto said first conveying surface portion of said second conveying means;

(e) tilting said predetermined number of sheets from said standing position on said lower edges to a laid position with said front surface of each of said sheets facing upwardly and with said lower edges facing forward in the direction of movement of said second conveying means due to forces exerted on said predetermined number of sheets as a consequence of said selected magnitudes of said angles and as a consequence of the difference between said speed $V_1$ of said first conveying surface and said component V of said speed $V_2$ of said second conveying means, the direction of said component V being in parallel to said first conveying surface; and (f) transferring said predetermined number of sheets from said second conveying means to and along a third conveying surface to a delivery location.

12. The apparatus according to claim 1, wherein said second conveying surface is substantially wide enough to stably support said predetermined number of sheets across their widths.

13. An apparatus for handling a stack of sheets of material comprising:

a first conveying surface for receiving and supporting the stack of sheets, each of said sheets having a front surface and a rear surface with each of said sheets positioned in a standing position on a lower edge, said first conveying surface is positioned substantially horizontally and driven at a predetermined speed $V_1$; and a second conveying surface for receiving a predetermined number of sheets of the stack of sheets and for pivoting said predetermined number of sheets from a standing position to a laid position, said second conveying surface being positioned adjacent to said first conveying surface, said second conveying surface including a first conveying surface portion and a second conveying surface portion, said first conveying surface portion inclined at a first angle relative to said first conveying surface, said second conveying surface portion disposed substantially horizontally at a second angle relative to said first conveying surface portion of said second conveying surface, said second conveying surface being driven at a predetermined speed $V_2$ having a vector component V;

wherein the magnitude of said first angle, said second angle, said predetermined speed $V_1$ of first conveying surface and said predetermined speed $V_2$ of said second conveying surface are selected so that said predetermined number of sheets are pivoted from a standing position on said lower edges to a laid position with said front surface of each of said sheets facing upwardly and with said lower edges facing forward in the direction of movement of said second conveying surface due to forces exerted on said predetermined number of sheets as a consequence of said selected magnitudes of said angles and as a consequence of the difference between said speed $V_1$ of said first conveying surface and said component V of said speed $V_2$ of said second conveying surface, the direction of said component V being in parallel to said first conveying surface;

wherein said first angle is greater than said second angle; and wherein said speed $V_2$ of said second conveying surface is greater than said speed $V_1$ of said first conveying surface.

14. The apparatus according to claim 13, including a lifting means for lifting up above said second conveying surface, a few sheets which are positioned forward of a remaining group of said stack of sheets positioned on said first conveying surface, after said predetermined number of sheets are transferred from the first conveying surface to said second conveying surface.

15. The apparatus according to claim 13, wherein said second conveying surface is substantially wide enough to stably support said predetermined number of sheets across their widths.

16. An apparatus for handling a plurality of sheets of material, each of said sheets having a pair of faces and a plurality of edges, said apparatus comprising:

first conveying means for receiving and conveying a stack of said sheets, said first conveying means including a substantially horizontally disposed first conveying surface which receives said sheets stacked face to face and collectively supported on edge and conveys said stack of sheets, said first conveying surface being driven at a predetermined speed $V_1$;

second conveying means, positioned adjacent to said first conveying means for tilting a substack of said stack of sheets, said second conveying means including a second conveying surface, said second conveying surface having a first portion and a second portion, said first portion being inclined at a first angle with respect to said first conveying surface, said second portion operatively connected to said first portion for receiving said substack of sheets from said first portion, said second portion being more horizontally disposed than said first portion and being inclined at a second angle relative to said first portion, said second conveying surface being driven at a predetermined speed $V_2$ having a vector component V; and third conveying means positioned adjacent said second conveying means for receiving and transporting said substack of said stack of sheets in a face supported position from said second conveying means to a delivery location; and wherein the magnitudes of said first angle, said second angle, and speed of said first and second conveying surfaces are selected so that said substack of said stack of sheets are pivoted from a standing position on edge to a laid position by said first and second conveying means due to forces exerted on said stack of sheets as a consequence of said selected magnitudes of said angles and as a consequence of the difference between said speed $V_1$ of said first conveying surface and said component V of said speed $V_2$ of said second conveying surface, the direction of said component V being in parallel to said first conveying surface, wherein said first angle is greater than said second angle, and wherein said second conveying surface is driven at a faster speed than said first conveying surface.

17. The apparatus according to claim 16, including a lifting means for lifting up above said second conveying surface a few sheets which are positioned forward of a remaining group of said stack of sheets positioned on said first conveying surface, after said substack of said stack of sheets are transferred from said first conveying means to said second conveying means.

18. The apparatus according to claim 16, wherein said second conveying surface is substantially wide enough to stably support said substack of said stack of sheets across their widths.

* * * * *